US006338535B1

(12) United States Patent
Rickert

(10) Patent No.: US 6,338,535 B1
(45) Date of Patent: Jan. 15, 2002

(54) PILL ORGANIZER

(76) Inventor: Marie Barna Rickert, 1 Anchorage Ct., Savannah, GA (US) 31410

( * ) Notice: Subject to any disclaimer, the term of this patent is extended or adjusted under 35 U.S.C. 154(b) by 0 days.

(21) Appl. No.: 09/466,457

(22) Filed: Dec. 17, 1999

(51) Int. Cl.[7] ..... A47B 88/00

(52) U.S. Cl. ..... 312/311; 312/244; 312/245; 312/234.1

(58) Field of Search ..... 312/311, 244, 312/245, 234.1, 330.1, 100, 309, 310, 119, 122, 126, 128

(56) References Cited

U.S. PATENT DOCUMENTS 68,073 A * 8/1867 Hayes et al.
106,240 A * 8/1870 Watson et al. ..... 312/119
107,753 A * 9/1870 Belding ..... 312/126 X
927,625 A * 7/1909 Woldridge ..... 312/126
2,290,307 A * 7/1942 Wicker
2,966,386 A * 12/1960 Gross ..... 312/127 X
2,966,387 A * 12/1960 Mills, Jr. ..... 312/128 X
3,301,619 A * 1/1967 Mead
3,821,538 A * 6/1974 Jonathan et al. ..... 312/128 X
4,231,626 A * 11/1980 Amtmann et al.
4,285,558 A * 8/1981 Medford ..... 312/128 X
4,634,193 A * 1/1987 Liu
5,102,209 A * 4/1992 Hesseltine ..... 312/311 X

* cited by examiner

*Primary Examiner*—Peter M. Cuomo
*Assistant Examiner*—Hanh V. Tran
(74) *Attorney, Agent, or Firm*—John D. Gugliotta; Michael J. Corrigan

(57) ABSTRACT

An apparatus is provided having, a set of small drawers that hold a specific type of medication and can be pulled and the contents emptied when needed. Medications are placed within the drawers and labeled. When it is time to ingest the medication, one simply pulls out a drawer and takes out its content. The present embodiment provides as step-like arrangement and hold multiples of 7 days of medication. The device can have holes on the back for hanging or magnets for securing to a metallic surface. Additionally, a smaller unit can be made transportable with the addition of a carrying strap.

8 Claims, 4 Drawing Sheets

PILL ORGANIZER

RELATED APPLICATIONS

The present invention was first described in Disclosure Document Number 455329 filed on Apr. 23, 1999. There are no previously filed, nor currently any co-pending applications, anywhere in the world.

BACKGROUND OF THE INVENTION

1. Field of the Invention

The present invention relates generally to an apparatus for organizing pills and vitamins and, more particularly, to a stepped multi-chambered pill organizer and dispenser for holding pills in multiples of seven days.

2. Description of the Related Art

As the medical profession continues to break new grounds in disease prevention and control, a steady stream of new drugs and vitamins enter doctors' offices, pharmacies and stores for consumption by patients worldwide. As our society becomes more and more sophisticated, the strife for health and longevity results in many of us relying on these modern remedies as a part of a daily maintenance regiment. It is becoming commonplace where one may be required to ingest several pills at several different times of the day, in many instances for the rest of that individual's life. With the ever-increasing role that these medications and vitamins play in one's life come several concerns. There is always the possibility that too much or too little of a prescription or vitamin is taken, that the wrong prescription or combination of prescriptions is taken, or that the prescription or vitamin is forgotten altogether. Complicating the matter is the question of what to do when one of these situations occurs. Keeping track of which medications have to be taken and when has become a major chore faced by millions. The development of the Pill Organizer will serve to alleviate these concerns.

In the related art, there exists many patents for devices which are designed to sort vitamins and pills and the like and to store and dispense them according to some chronological scheme. There exists devices which compute when to dispense medications via mechanical means or via computer logic, devices which have an alarm to signal when to take medications, as well as devices which enable the user to carry medications with them. The present invention is of the last type of inventions presenting a novel pill organizer and dispenser being portable in nature and providing storage and dispensing capability for dispensing pills three times a day for a period of two weeks at a time, 2 times a day for a period of 3 weeks, or once a day for forty two days.

A search of the prior art did not disclose any patents that read directly on the claims of the instant invention; however, the following references were considered related:

| U.S. Pat. No. | Inventor | Issue Date |
|---|---|---|
| 5,609,268 | Shaw | Mar. 11, 1997 |
| 5,472,113 | Shaw | Dec. 5, 1995 |
| 4,953,745 | Rowlett et al. | Sep. 4, 1990 |
| 4,223,801 | Carlson | Sep. 23, 1980 |
| 5,755,357 | Orkin et al. | May 26, 1998 |
| 5,657,236 | Conkright | Aug. 12, 1997 |
| 5,495,961 | Maestre | Mar. 5, 1996 |
| 5,347,453 | Maestre | Sep. 13, 1994 |
| 4,807,757 | Rappaport et al. | Feb. 28, 1989 |

-continued

| U.S. Pat. No. | Inventor | Issue Date |
|---|---|---|
| 4,839,806 | Goldfischer et al. | Jun. 13, 1989 |
| 4,573,606 | Lewis et al. | Mar. 4, 1986 |
| D 400,006 | Girvetz | Oct. 27, 1998 |
| D 348,562 | Smith | Jul. 12, 1994 |

SUMMARY OF THE INVENTION

It is therefore an object of the present invention to provide an improved pill and vitamin dispenser.

It is another object of the present invention to eliminate over or under medication dosages.

It is therefore an object of the present invention to improve health.

It is another object of the present invention to facilitate the timely ingestion of medications.

It is a feature of the present invention to provide a stepped configuration.

It is an advantage of the present invention handles multiple people or whole family.

It is an advantage of the present invention to increase safety.

It is an advantage of the present invention to allows multiple rows to be opened at once for filling.

It is a feature of the present invention to save time opening individual bottles.

It is a feature of the present invention to be transportable for trips or vacations.

Briefly described according to one embodiment of the present invention, the Pill Organizer removes the need to manually keep track of medication dosages and schedules by providing a compartmentalized pill case that aids in the dispensing duties as well as providing a means to schedule medications and vitamins. The Pill Organizer is arranged in a stepped format to allow for multiple rows in a seven-column configuration to be opened at once. This aids in the filling and collating process by allowing for vitamins or medication that must be taken once a day or more to be loaded in all the appropriate drawers simultaneously. Depending on the frequency of dispensing, more than one person could use the invention at once, possibly up to six, though fewer or more are also possible. Medications or vitamins would be dispensed as needed on a daily or hourly basis. If medication is to be taken at different times daily, the pillbox will hold a variable number of days worth of medicine, depending upon the number of dosages and time intervals involved. The Pill Organizer is designed so that it is very easy to use. The user or caregiver simply fills the drawers with the appropriate dosages of medication or vitamins. As the time to take each dosage approaches, the user simply removes the entire drawer and removes all contents for consumption.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

| | |
|---|---|
| 10 | Pill Organizer |
| 15a | Left Sidewall |
| 15b | Right Sidewall |
| 15c | Bottom Sidewall |
| 15d | Rear Sidewall |
| 15e | Top Panel |
| 15f | Lid |
| 15g | Carrying Strap |
| 15h | Hinge |
| 16a | First Separator Panel |
| 16b | Second Separator Panel |
| 16c | Third Separator Panel |
| 16d | Fourth Separator Panel |
| 16e | Fifth Separator Panel |
| 16f | Tab |
| 17a | Panel Stringer |
| 17b | Cross Panel Stringer |
| 18 | Drawer |
| 18a | Drawer Handle |

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
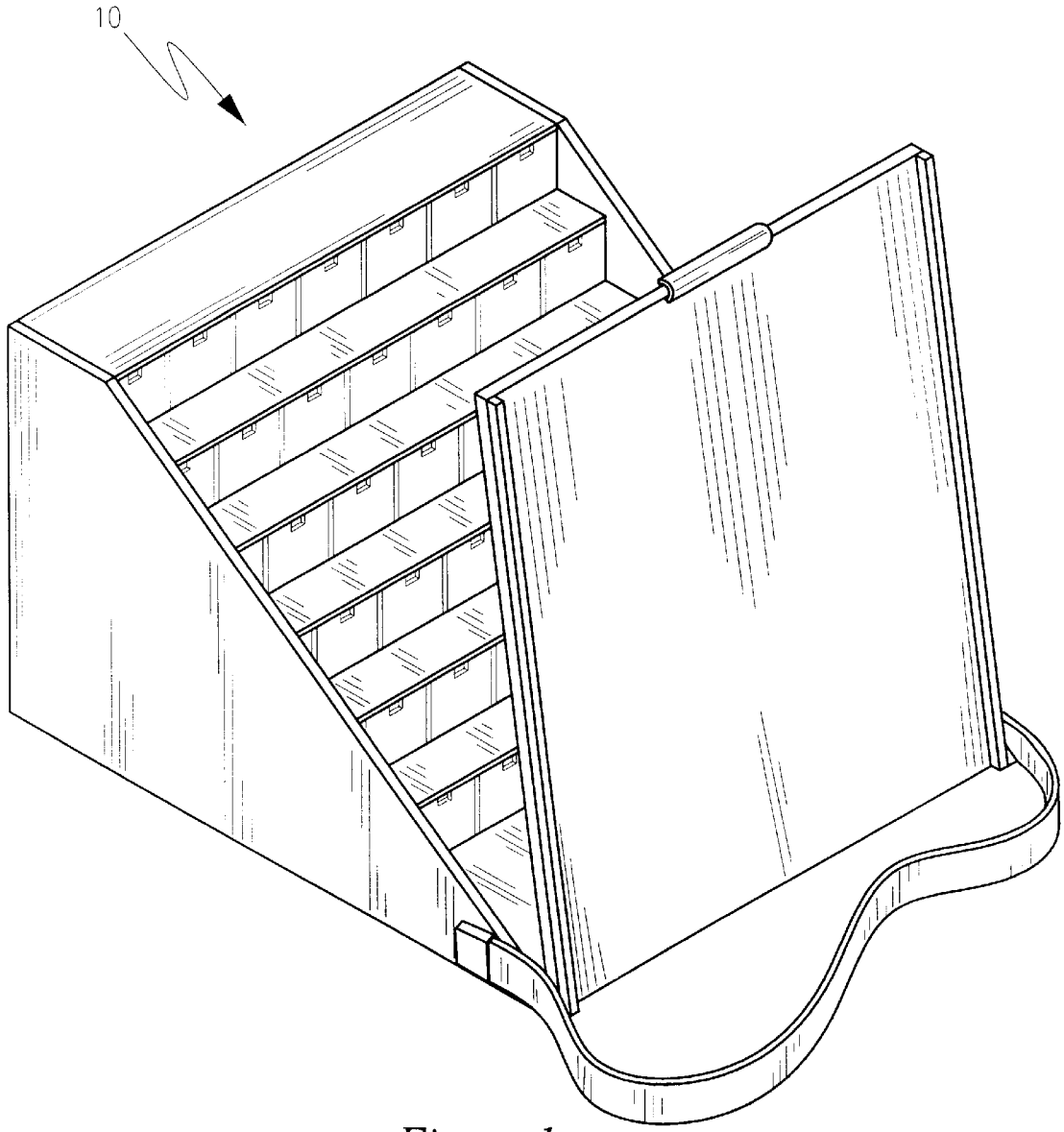
FIG. 1 is a perspective view of a Pill Organizer, according to the preferred embodiment of the present invention.

Referring now to FIG. 1, a Pill Organizer 10 is shown, according to the present invention, for holding in an organized fashion for a pre-selected period of time a supply of pills and vitamins and the like. Essentially the device consists of a self contained organizer having a plurality of drawers arranged in rows and columns wherein one row of drawers is stacked in stepped layers upon the row beneath it. There are enough individual drawers to hold pills and vitamins and the like for dispensing three times a day for a two week period, 2 times a day for a period of 3 weeks, or once a day for forty two days. A lid attached to the housing via a hinge 15*h* secures the drawers inside the interior volume of the housing when not in use or being transported. A carrying strap 15*g* is provided for easy carrying on the go.

Figure 2:
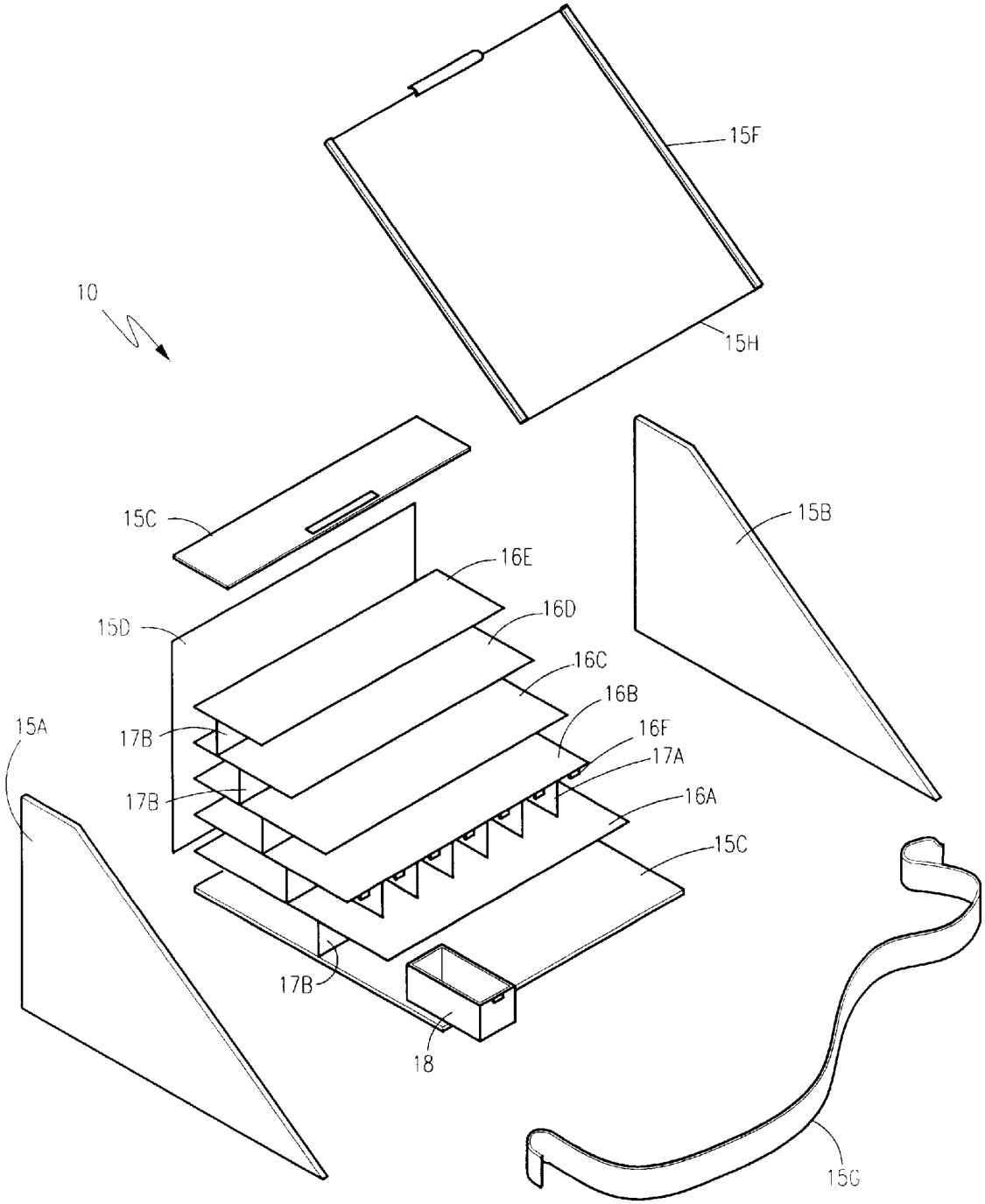
FIG. 2 is an exploded perspective view of a Pill Organizer, according to the preferred embodiment of the present invention.

Referring to FIG. 2, shown is an exploded perspective view of a Pill Organizer 10, showing the detail of how the unit is constructed. The housing of the unit is constructed of a left sidewall 15*a*, right sidewall 15*b*, bottom sidewall 15*c*, rear sidewall 15*d*, and a top panel 15*e*. These sidewalls 15*a* through 15*d* and panel 15*e* can be fashioned out of any flat sheeting material that can be cut into the desired sizes and fastened together such as plastic or wood. The exterior surfaces of sidewalls 15*a* through 15*d* may be covered with water and airtight fabric or material. Together these components form a housing wherein the multi-layered stepped structure is inserted for receiving the plurality of drawers 18 (only one is shown for illustrative purposes) which hold the pills and vitamins. A lid 15*f* is then attached via a hinge 15*h* to the housing along the front edge of bottom sidewall 15*c*. It is envisioned that a latching means would also be added to keep lid 15*f* securely shut until it is desired to get a pill or vitamin from the unit. The latching means chosen is not important for purposes of disclosure as many off the shelf hardware devices would be suitable for this purpose. Lid 15*f* serves to prevent drawers 18 from falling out of their cavities to impinging on the front edge of the drawer 18 when it is in the latched position.

As heretofore discussed, the Pill Organizer 10 consists of a plurality of drawers 18 assembled into a tier arrangement. A plurality of seven drawers 18 are arranged in a row to represent a week's worth of medications. Two additional rows are provided above this row to provide an additional dispensing capacity for an additional dose two other times in a day. Above these three rows of drawers 18 are another three rows of seven drawers 18 each representing an additional week's worth of pills and vitamins dispensed three times daily. The drawers 18 may be labeled according to the day of the week and the time of the o day. For disclosure purposes only and not meant as a limitation, it is suggested that the three times of day be labeled as A.M., Noon, and P.M. as these are common times and intervals when medications are dispensed. Other combinations of pill dispensing timetables are possible such as 2 times a day for a period of 3 weeks, or once a day for forty two days.

A stepped structure for receiving each of the drawers 18 is provided consisting of several layers of panels and support stringers as illustrated. Essentially, a first separator 16 panel divides the interior volume of the housing heretofore described into sections. A plurality of panel stringers 17 further subdivide the resulting lower section further, and the cavity for receiving a single drawer is then completed by a cross panel stringer 17*b* located rearward of drawer 18 when it is fully inserted. A plurality of small tabs 16*f* are provided on the lower surface and front edge of separator panels 16*a* through 16*e* and the center between each of said stringer panels 17*a* as shown. Tab 16*f* is provided to prevent drawer 18 from completely exiting the cavity it is housed in by engaging the rear sidewall of drawer 18. Drawer 18 can be removed completely and then reinserted by tilting drawer 18 slightly upward until tab 16*f* clears the rear sidewall of drawer 18.

To complete the assembly, a second separator panel 16*b* is added along with stringers 17*a* and cross panel stringers 17*b*. This repeated with third separator panel through fifth separator panel with stringers 17*a* separating them and cross panel stringer 17*b* completing the cavity for receiving a drawer 18. Top panel 15*e* acts as the final panel completing the cavity for a drawer 18 in the uppermost row of drawers 18.

It is envisioned that the distance that each row is staggered by the row beneath it would be 1 and ½ inches. The entire unit would measure six inches high, 9 and ½ inches deep and 10 and ½ inches wide. Each drawer 18 would measure 1 and ½ inches deep, 1 and ½ inches wide, and one inch high. These measurements are meant only as suggestion and in now way imply any limitation on the size of the invention.

The Pill Organizer 10 can have an attachment means such as holes on the back for hanging or magnets for securing to a metallic surface. Additionally, a smaller unit can be made transportable with the addition of a carrying strap 15*g*. It is envisioned that carrying strap 15*g* would be a strap that is common on luggage articles and handbags and the like. Strap 15*g* would be attached to the exterior surface of panel 15*a* and panel 15*b* near the front edge via clips that are common with straps of this type.

Figure 3:
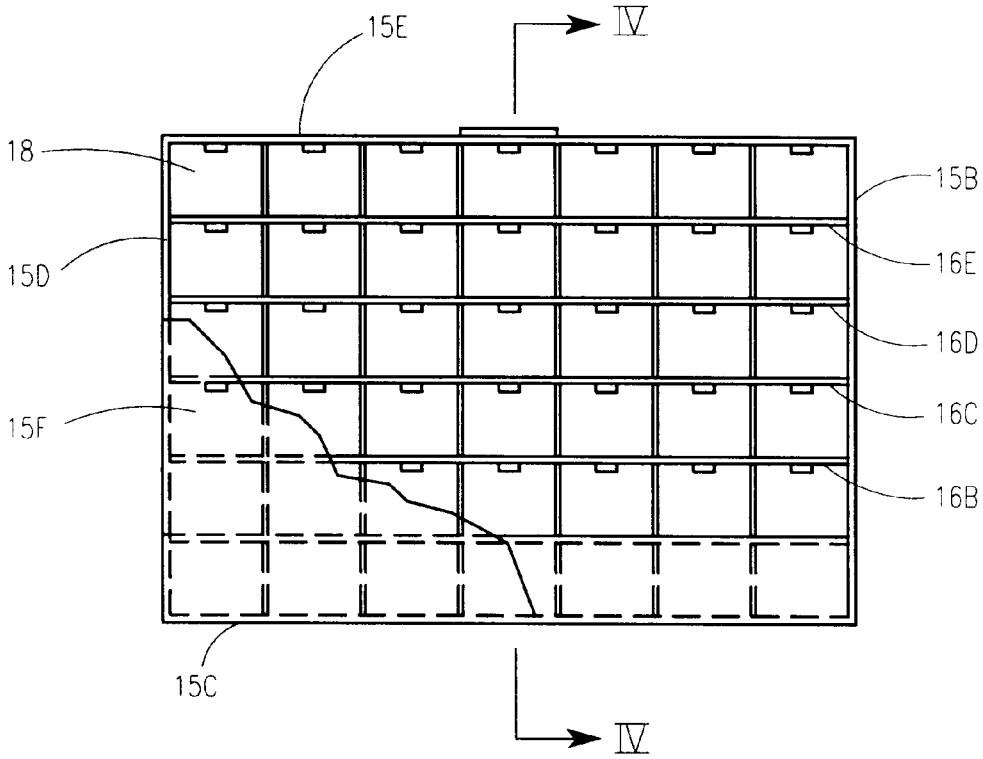
FIG. 3 is a partial cutaway front view of a Pill Organizer with the carrying strap removed, according to the preferred embodiment of the present invention.

FIG. 3 shows a front view of a Pill Organizer 10 showing the arrangement of drawers 18 in rows of seven stacked upon each other for dispensing pills or vitamins three times a day for a period of two weeks. The front face of the drawers 18 may be labeled to indicate the day and time of day when the contents therein are to be dispensed.

Figure 4:
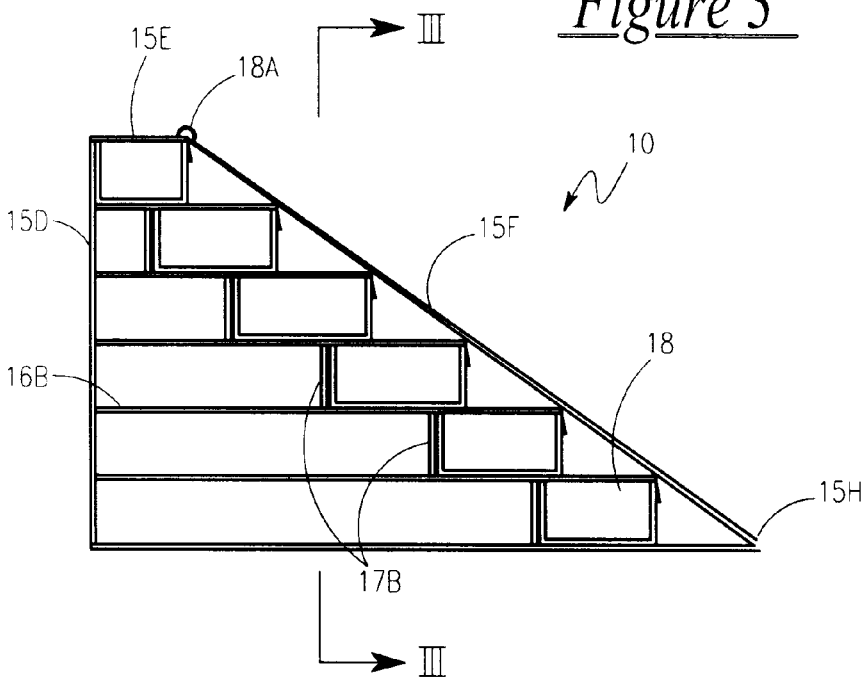
FIG. 4 is a cross sectional side view of a Pill Organizer taken along line III—III of FIG. 3, according to the preferred embodiment of the present invention.

FIG. 4 shows cross sectional view of a Pill Organizer 10 taken along line III—III of FIG. 3 showing how the rows of drawers 18 are stacked one upon another and then staggered so that the row above is behind the row beneath it.

Figure 5:
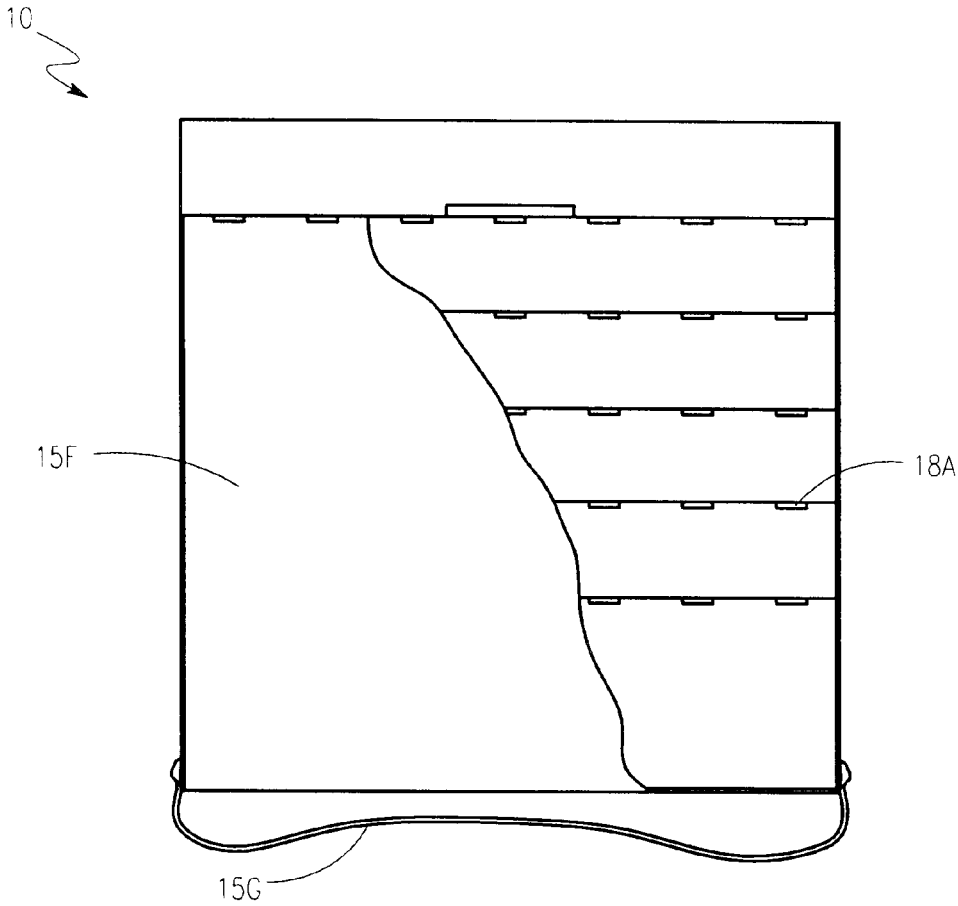
FIG. 5 is a partial cutaway top view of a Pill Organizer, according to the preferred embodiment of the present invention.
Figure 6:
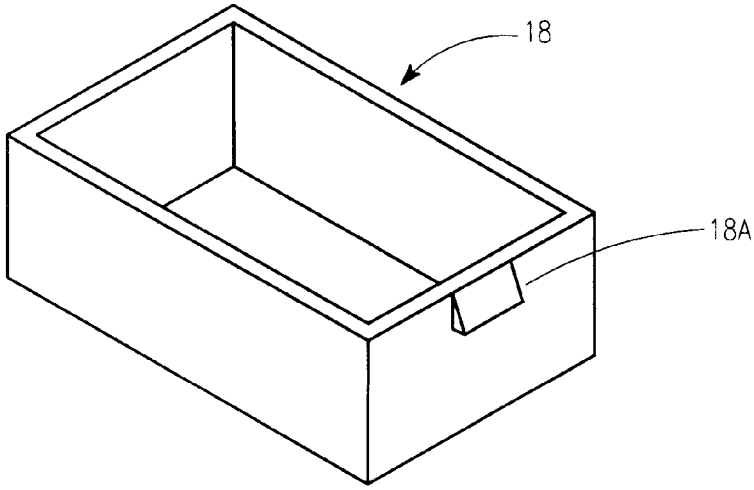
FIG. 6 is a perspective view of a drawer from a Pill Organizer, according to the preferred embodiment of the present invention.

FIG. 5 shows a partial cutaway top view of a Pill Organizer 10 showing the arrangement of drawers 18 in the staggered arrangement as heretofore described. Finally, FIG. 6 shows one of the plurality of drawers 18. Essentially, drawer 18 is of a rectangular configuration with four sidewalls and a bottom wall defining a vessel with an interior volume. A drawer handle 18*a* is provided on the front sidewall for the user to grasp when opening and closing the drawer. Drawer 18 is sized to fit within the cavity formed by the separator panels and panel stringers.

2. Operation of the Preferred Embodiment

In operation, pills and vitamins are pre-loaded in a series of drawers arranged in rows and columns in a tiered arrangement. There are enough individual drawers to hold pills and vitamins and the like for dispensing three times a day for a two week period, 2 times a day for a period of 3 weeks, or once a day for forty two days. A tab on the unit prevents the drawer from completely exiting the housing. The drawer is closed shut by simply pushing it back into the housing. A lid keeps the drawers shut while the unit is being carried. A strap is provided to make the unit easy to carry.

The foregoing description is included to illustrate the operation of the preferred embodiment and is not meant to limit the scope of the invention. The scope of the invention is to be limited only by the following claims.

What is claimed is:

1. A multi-drawer chronological pill organizer and storage device for holding in an organized fashion for a pre-selected period of time a supply of pills and vitamins, said device comprised of:

a plurality of drawers, said plurality of drawers for receiving and storing said vitamins and pills;

a housing, said housing having an inner volume fashioned in a multi-layered stopped, structure for receiving said plurality of drawers;

a lid, said lid being attached to said housing via a hinge for preventing said plurality of drawers from falling out of said inner volume of said housing when said device is not in use or being transported;

a latching means, said latching means to keep said lid securely shut until it is desired to get a pill or vitamin from said plurality of drawers;

and a carrying strap, said carrying strap for transporting said device wherein said multi-layered stepped structure for receiving said plurality of drawers having layers of panels and support stringers comprised of:

first, second, third, fourth and fifth separator panels, said first, second, third, fourth and fifth separator panels for diving said interior volume of said housing into sections;

a plurality of panel stringers, said plurality of panel stringers for further subdividing said interior volume into smaller sections between each of said first, second, third, fourth and fifth separator panels, and wherein a cavity for receiving a single drawer from said plurality of drawers is completed by the placement of a single cross panel stringer between each of said first, second, third, fourth and fifth separator panels in a perpendicular fashion to said plurality of panel stringers and located rearward to said plurality of drawers when said plurality of drawers are in fully inserted position.

2. The multi-drawer chronological pill organizer and storage device of claim 1, wherein said housing is comprised of a left sidewall, a right sidewall, a bottom sidewall, a rear sidewall, and a top panel, which can be fashioned out of any flat sheeting material that can be cut into the desired sizes and fastened together, said material selected from the group consisting of plastic or wood.

3. The multi-drawer chronological pill organizer and storage device of claim 1, wherein said multi-layered stepped structure for receiving said plurality drawers having layers of panels and support stringers further comprised of:

a plurality of small tabs, said plurality of small tabs provided on a lower surface and a front edge of said first, second, third, fourth and fifth separator panels and the center between each of said plurality of panel stringers to prevent said every drawer from said plurality of drawers from completely exiting said cavity said drawer is housed in by engaging a rear sidewall of said drawer;

a top panel, said top panel completing said cavity for said plurality of drawers located in the uppermost row of said housing;

wherein said plurality of drawers can be removed completely and then reinserted by tilting said drawer from said plurality of drawers slightly upward until said tab clears the rear sidewall of said drawer.

4. The multi-drawer chronological pill organizer and storage device of claim 3, wherein each of said drawers from said plurality of drawers is of a rectangular configuration with four sidewalls and a bottom wall defining a vessel with an interior volume and is sized to fit within the cavity formed by said first, second, third, fourth and fifth separator panels and said plurality of panel stringers, said drawer having a handle provided on a front sidewall for the user to grasp when opening and closing the drawer.

5. The multi-drawer chronological pill organizer and storage device of claim 1, wherein the distance that each row of plurality of drawers is staggered from the row of plurality of drawers beneath by 1 and ½ inches, said device measures six inches high, 9 and ½ inches deep and 10 and ½ inches wide, and each drawer from said plurality of drawers measures 1 and ½ inches deep, 1 and ½ inches wide, and one inch high.

6. The multi-drawer chronological pill organizer and storage device of claim 1, wherein said plurality of drawers are arranged in rows of seven stacked upon each other for dispensing pills or vitamins three times a day for a period of two weeks, 2 times a day for a period of 3 weeks, or once a day for forty two days, and wherein a front face of each of said drawers from said plurality of drawers may be labeled to indicate the day and time of day when the contents in said drawer is to be dispensed.

7. The multi-drawer chronological pill organizer and storage device of claim 1, wherein said device has an attachment means for attaching said device to a surface.

8. The multi-drawer chronological pill organizer and storage device of claim 2, wherein an exterior surface of said left sidewall, said right sidewall, said bottom sidewall, said rear sidewall, and said top panel are covered with water and airtight fabric or material.

* * * * *